United States Patent [19]

Burke et al.

[11] 4,402,251

[45] Sep. 6, 1983

[54] DETECTION OF LINE OF SIGHT REVERSAL AND INITIATION OF FIRING COMMANDS FOR A MODIFIED ACCELERATION PREDICTOR FIRE CONTROL SYSTEM ENGAGING MANEUVERING TARGETS

[75] Inventors: Harold H. Burke; Toney R. Perkins, both of Bel Air, Md.

[73] Assignee: The United States of America as represented by the Secretary of the Army, Washington, D.C.

[21] Appl. No.: 303,664

[22] Filed: Sep. 18, 1981

[51] Int. Cl.[3] ..... F41G 5/06

[52] U.S. Cl. ..... 89/41 ME

[58] Field of Search ..... 89/41 E, 41 ME, 41 L

[56] References Cited

U.S. PATENT DOCUMENTS 3,339,457 9/1967 Pun ..... 89/41 L

*Primary Examiner*—Stephen C. Bentley

*Attorney, Agent, or Firm*—Robert P. Gibson; Anthony T. Lane; Saul Elbaum

[57] ABSTRACT

A weapon fire control system is operated to measure line-of-sight angular rate and estimate velocity and acceleration of a maneuvering target. The apparent area of the maneuvering target is continuously monitored and when it becomes a value that is some preselected amount greater than the maneuvering target's head-on area, the gun line offset servos of the weapon are commanded to develop an offset which is a function of target velocity and acceleration. When the line-of-sight angular rate crosses through zero, a firing command is initiated. For a class of maneuvering targets where the product of target velocity and projectile time of flight is much less than the engagement range, performance of the weapon fire control system will be improved and power requirements of the gun line offset servo will be reduced.

7 Claims, 7 Drawing Figures

DETECTION OF LINE OF SIGHT REVERSAL AND INITIATION OF FIRING COMMANDS FOR A MODIFIED ACCELERATION PREDICTOR FIRE CONTROL SYSTEM ENGAGING MANEUVERING TARGETS

RIGHTS OF THE GOVERNMENT

The invention described herein may be manufactured, used, and licensed by or for the United States Government for governmental purposes without the payment to us of any royalty thereon.

FIELD OF THE INVENTION

The present invention relates to weapon control systems and more particularly to a gun fire control system suited to respond to a class of maneuvering targets for which the product of target velocity and projectile time of flight is much less than the engagement range.

BRIEF DESCRIPTION OF THE PRIOR ART

The function of a gun fire control system is to offset the gun line from the target line-of-sight causing a projectile to intercept the target a time-of-flight after firing the gun. Two types of target motion occur, non-maneuvering and maneuvering. Projectile-target closest approach is a measure of miss distance. Non-maneuvering targets require a constant offset between the target line-of-sight and the gun line to minimize miss distance. The magnitude of the required offset is the product of the target apparent velocity and projectile time-of-flight. Maneuvering targets require a time varying offset having a magnitude related to the non-maneuvering target offset plus an additional offset related to the target acceleration, acceleration rate, etc., combined with the appropriate functions of projectile time-of-flight. Conventional state-of-the-art fire control systems use (1) target velocity or (2) target velocity and acceleration combined with time-of-flight to continuously determine gun line offsets. Application of sub-optimal estimation methodology, specifically Kalman filtering has resulted in the development of velocity plus acceleration controlled offsets that have increased the performance of gun fire control systems when maneuvering targets are engaged. The penalty associated with the adoption of these types of systems is the generation of "noise" associated with the estimation of accelerations. It is relatively simple to estimate velocities, but such is not the case for accelerations. Miss distance is penalized by errors introduced in the prediction calculation by this "noise." Current tactical vehicle mobility capabilities indicate that maneuvering targets require target acceleration estimates in addition to target velocity estimates.

BRIEF DESCRIPTION OF THE PRESENT INVENTION

This invention will permit the goal of improved fire control system performance to be realized by making design modifications to existing fire control systems. Investigations have shown that performance improvement can be realized by further modifying the gun line offset control law and limiting firing commands to times when the target line-of-sight rate is crossing through zero.

An additional advantage obtained from such a scheme is that at the time of projectile-target closest approach, the apparent area of the target will be greater than its frontal area, thereby increasing fire control system performance.

The above-mentioned objects and advantages of the present invention will be more clearly understood when considered in conjunction with the accompanying drawings, in which:

DETAILED DESCRIPTION OF THE INVENTION

Figure 1A:
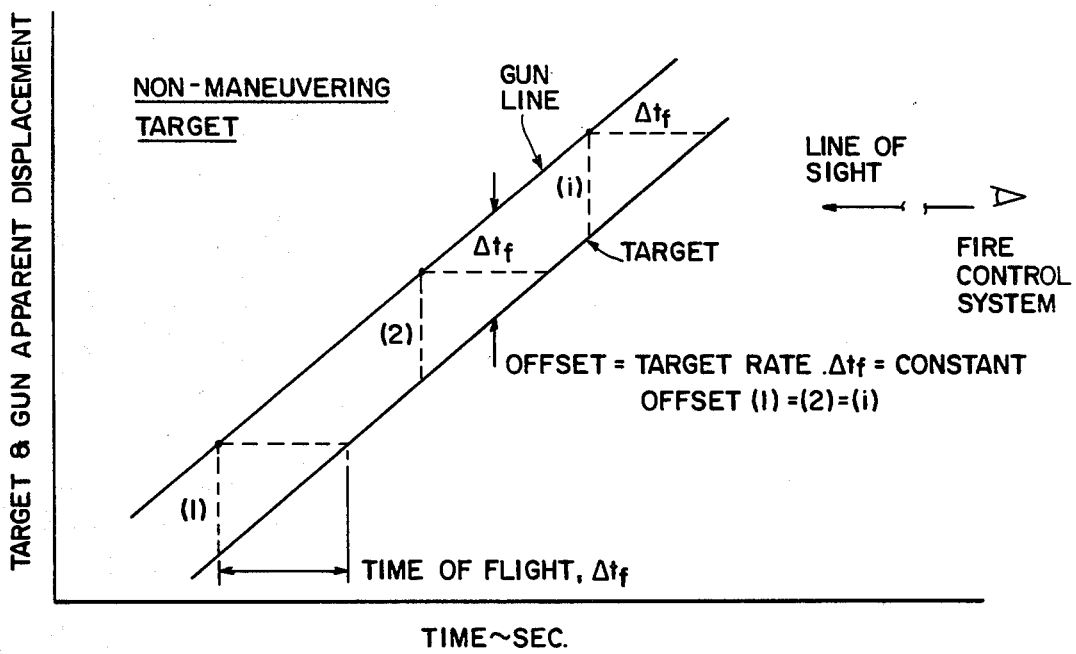
FIG. 1A is a plot illustrating required fire control offset for a non-maneuvering target.
Figure 1B:
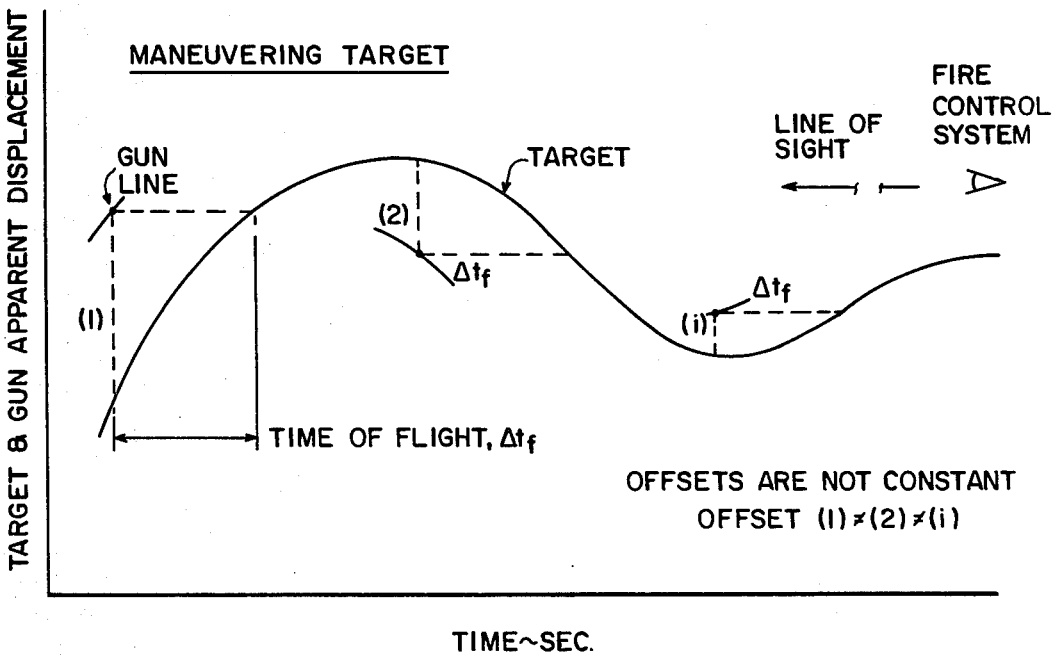
FIG. 1B is a plot illustrating required fire control offset for a maneuvering target.

FIGS. 1A and 1B are intended to describe the problem posed to a fire control system for both a maneuvering and non-maneuvering target, and indicates the fundamental difference between the two types of target movement. The offset of the gun line from the target as shown in FIGS. 1A and 1B for the two types of target motion assume different characteristics. The required offset is nominally a constant following the initial transient for the non-maneuvering target and it is continuously changing as a function of time for the maneuvering target case.

Performance of fire control systems engaging maneuvering targets is significantly degraded relative to their performance when non-maneuvering targets are engaged because of the inability to continuously develop the required offsets shown in FIG. 1B. Some of this loss in performance can be recovered by incorporating the concepts that are enumerated in this invention. Modification can be made to existing fire control systems that will provide this improvement.

The modifications alter the operation of several subsystems of present state-of-the-art fire control systems. Monitoring the apparent area of the target, actuating the gun line offset servos only at certain time periods when the line-of-sight rate is approaching zero as detected by the magnitude of apparent target area relative to the head-on area, incorporating a modified acceleration prediction algorithm, and initiating firing commands when the line-of-sight rate crosses zero are the basic features of the invention.

The requirement to sense and estimate target velocity and acceleration are fundamental to the principles of operation of the proposed system, but the utilization of these quantities is considerably different that their use in conventional state-of-the-art fire control systems.

Figure 2:
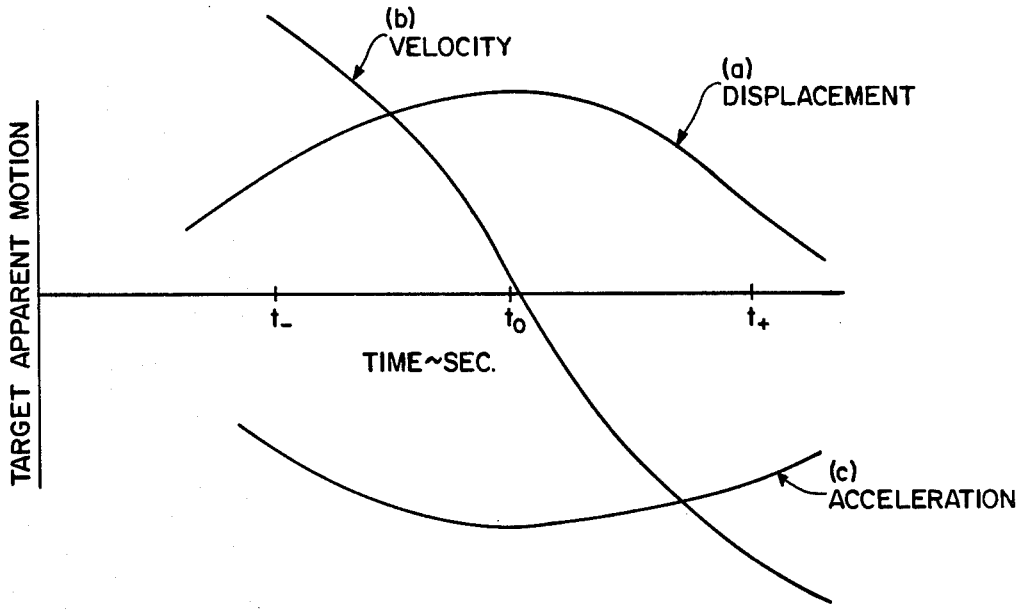
FIG. 2 is a plot of target apparent motion.

The four processes that function to provide a fire control solution are: (1) tracking, (2) estimation, (3) prediction, and (4) gun line offset. If a maneuvering target is observed by a fire control system as indicated in FIG. 2, the apparent movement of the maneuvering vehicle is the movement perpendicular to the line-of-sight between the fire control system and the target. In the region designated by $t_- - t_o - t_+$, the apparent movement of the maneuvering target has displacement trends shown in FIG. 2 (curve a). The apparent velocity crosses through zero as shown in FIG. 2 (curve b) and the apparent acceleration reaches a peak value when the apparent velocity crosses through zero and the apparent displacement is at its maximum value (curve c). The value of the apparent acceleration in the $t_- - t_o - t_+$ region for arcs on the maneuvering path less than ±45°, is a large percentage of the acceleration occurring at $t_o$.

Unlike existing state-of-the-art fire control systems, the localized behavior of the maneuvering target's movement in this $t_- - t_o - t_+$ region of FIG. 2 is exploited in this invention.

Figure 3:
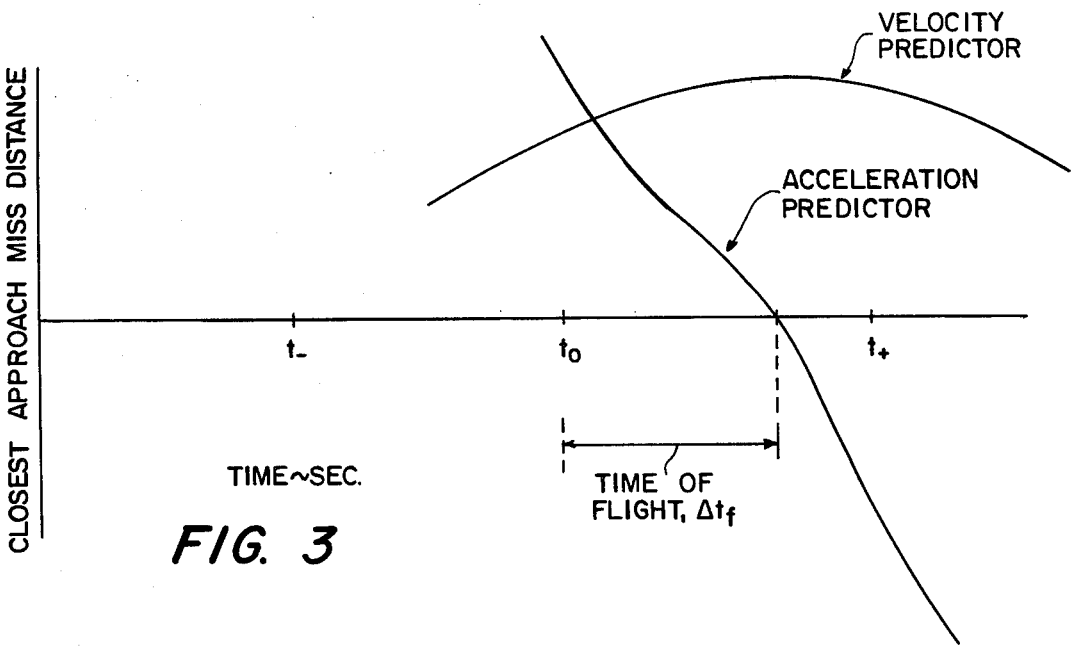
FIG. 3 is a plot of miss distance for a fire control system as a function of time.

The closest approach miss distance to a maneuvering target, moving as indicated in FIG. 2, for an assumed time of flight, has the shape of the curves shown in FIG. 3. Two curves are shown, one for an offset predictor that uses either apparent acceleration or apparent velocity. The important difference to observe between the two curves is that in the vicinity of $t_o + \Delta t_f$, which is the discrete time equal to the projectile time-of-flight measured from the time the line-of-sight crosses zero, the closest approach miss distance is near zero for the acceleration predictor.

Further improvement in the closest approach miss distance in the vicinity of line-of-sight reversal can be obtained by modifying the form of the acceleration prediction algorithm. The form of modified acceleration predictor is:

$$K \cdot \tfrac{1}{2} A_N \Delta t_f^2$$

K = adaptive gain related to target maneuver;

where $A_N$ = target acceleration normal to target velocity;

$\Delta t_f$ = projectile time-of-flight

Figure 4:
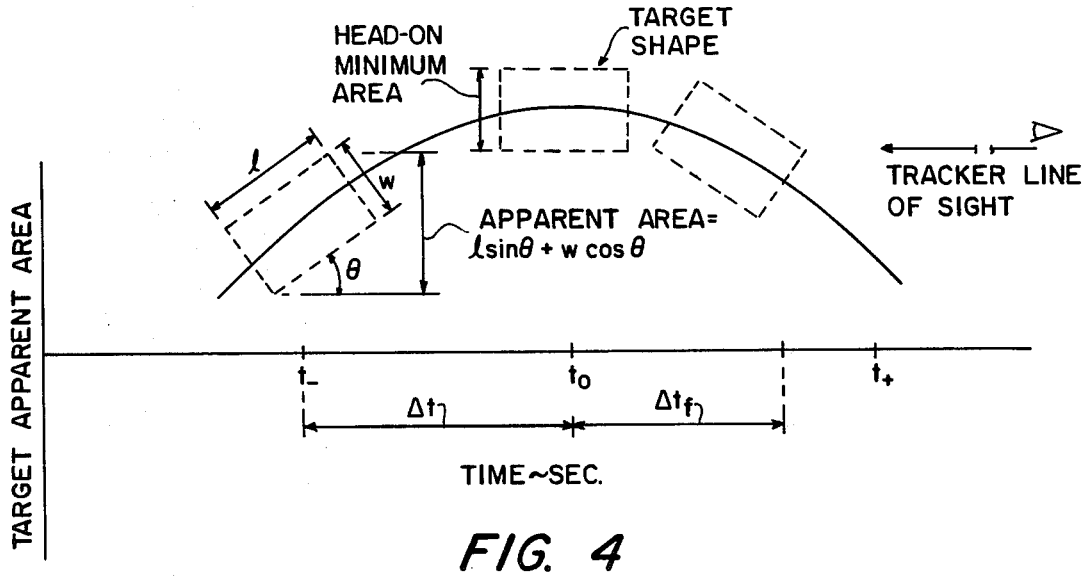
FIG. 4 is a plot of target apparent area for a maneuvering target.

State-of-the-art techniques employed in fire control systems require that the gun offset servo be energized continuously when maneuvering targets are engaged. This requirement may be undesirable because of excessive gun line stabilization and power requirements. A method employed by an existing class of fire control systems, used to engage non-maneuvering targets, may provide significant performance improvements when combined with the concepts proposed herein. The state-of-the-art "lead lock" system used to obtain a fixed magnitude offset solution based on constant target apparent velocity can be modified. For maneuvering targets the "lead lock" system commands incorrect offsets. If the characteristics of target apparent displacement, velocity and acceleration, as shown in FIG. 2 are utilized in the manner described in this invention, it is feasible to command the gun offset servo to orient the gun line ahead of the tracker line-of-sight commencing at some time interval prior to $t_o$. Determination of the time prior to $t_o$ to begin offset servo movement can be realized by monitoring the apparent size of the maneuvering target. FIG. 4 describes the geometry of the target needed to determine the apparent area/minimum apparent area ratio occurring at $t_-$, which is $\Delta t$ seconds from $t_o$.

Figure 5:
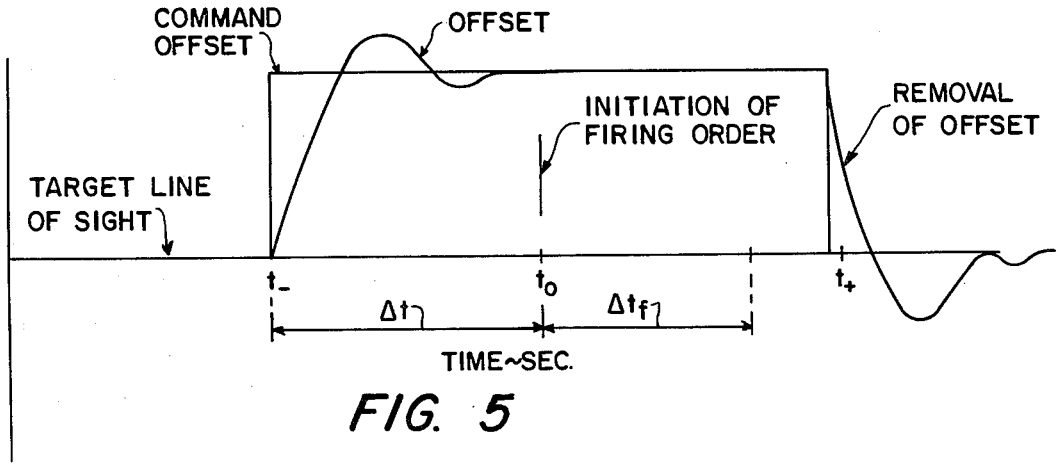
FIG. 5 is a plot of the command offset and response of a gun line offset servo.

FIG. 5 describes the sequence of events from $t_-$ to $t_o$ that occur between the time the gun line offset servo is actuated until the firing orders are initiated followed by removal of the gun line offset at $t_+$. The advantages realized by operating the gun line offset servo only in this region, rather than mechanizing a conventional state-of-the-art velocity plus acceleration predictor that continuously commands offset servo are appreciated when it is observed that greater offset servo control power is required in the regions where the apparent velocity of the maneuvering vehicle is non zero. For example, vehicles having apparent velocities are accelerations of 10 meters/sec and 3 meters/sec$^2$, typical for maneuvering land vehicles, and 50 meters/sec and 10 meters/sec$^2$, typical for rotary wing air vehicles, the power demands are less in the maximum acceleration regions.

The following modifications in the operation of existing state-of-the-art fire control systems will be required to mechanize this fire control system concept. The line-of-sight rate to the maneuvering target is measured by an inertial sensor and is continuously monitored by the fire control system. The normalized presented area of the maneuvering target is monitored and at some time $\Delta t$ prior to the occurrence of the minimum presented area, the gun line servo is commanded to commence to develop an offset. The servo will initially operate in a transient mode, followed by a slowly changing movement. When the line-of-sight rate crosses zero (or the minimum area of the target occurs), the firing command signal is initiated.

The initial actuation of the gun line offset servo at some $\Delta t$ prior to the time when the apparent maneuvering vehicle velocity crosses zero will occur in general when the apparent target acceleration is less than the value occurring when the projectile firing command is initiated. Therefore, the gun line offset will be continuously adjusted in the $t_- - t_o$ region.

In the event it is desirable to continuously command an offset servo instead of generating commands only in the time interval from $t_-$ to $t_o$, the invention provides means for doing so as will be explained in connection with FIG. 6.

Figure 6:
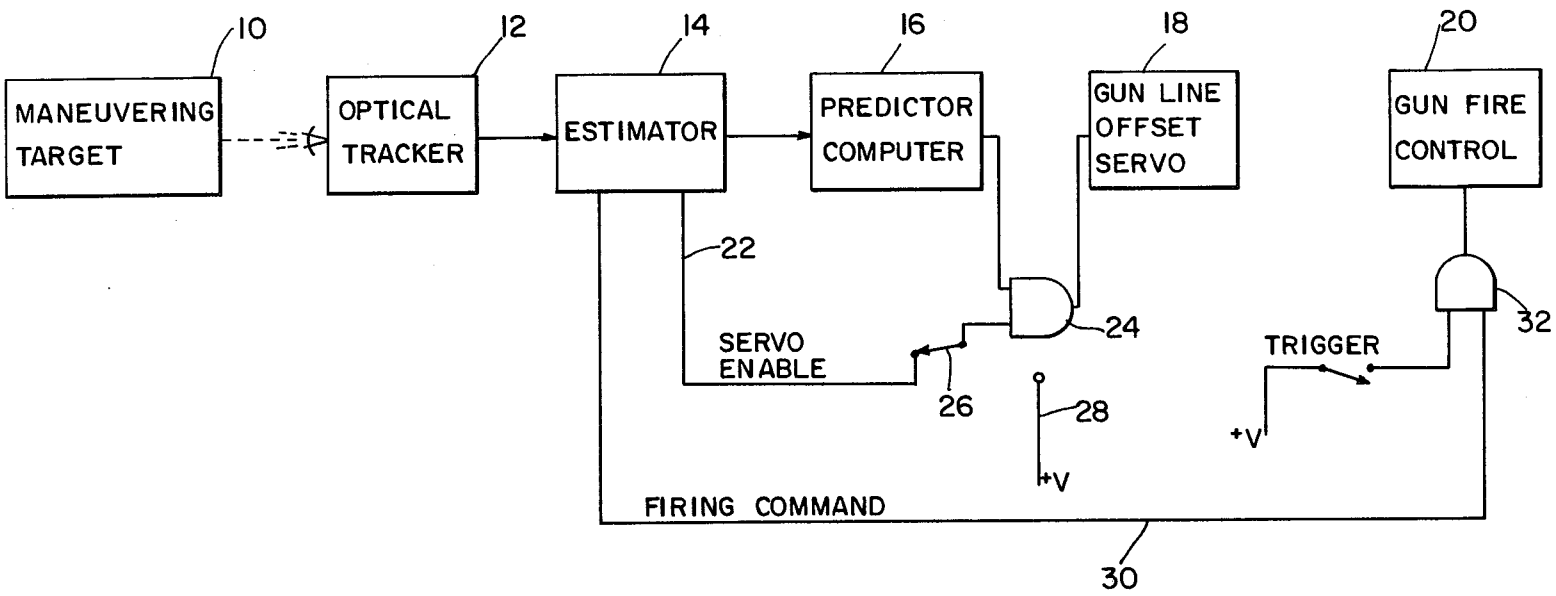
FIG. 6 is a block diagram of a fire control system as employed in the present invention.

Reference is now made to FIG. 6 which is a block diagram of a fire control system incorporating the realizations of the present invention. The block diagram of FIG. 6 illustrates a maneuvering target 10 which is tracked by an optical tracker 12 of conventional design. Data regarding the maneuvering target is provided from the output of tracker 12 to the input of a target state estimator 14 of conventional design. The target state estimator performs signal processing upon the input from the tracker 12, such as Kalman filtering. Further, the estimator includes means for detecting area variations of the optically tracked maneuvering target. The latter is a conventional technique as included in the HIMAG System, manufactured by the Delco Division of General Motors. The processed target state signals from estimator 14 are provided to the predictor computer 16 which is of a type conventionally found in gun fire control systems. Such a computer generally includes a microprocessor for calculating gun line offset equations and furnishing offset signals to a gun line offset servo such as 18. The servo 18 positions a gun or similar weapon relative to the tracker line-of-sight so that when the gun is fired, it is pointed in the direction of the anticipated intersection of the projectile with the target a time of flight later. The gun fire control 20 is also of a conventional design which electromechanically fires a gun in response to trigger actuation.

A fundamental aspect of the present invention is to provide a program to the predictor computer 16 for calculating the prediction algorithm:

$$T_f = T_p + \left[1 - \frac{\omega^2 \Delta t_f^2}{12}\right] \cdot \frac{1}{2} A_N \Delta t_f^2$$

where $T_f$, $T_p$=target position-future and present;

$A_N$=target acceleration normal to target velocity;

V=target velocity;

$\Delta t_f$=projectile time-of-flight;

$A_{N/V}=\omega$;

$\omega$=cyclic frequency of maneuvering target.

In the event the gun line offset servo 18 is to undergo physical movement between the time interval $t_-$ to $t_o$, as previously discussed, the estimator 14 generates a servo enable signal along lead 22 when the tracked target presents a predetermined apparent area/head-on area ratio as discussed in connection with FIG. 4. Upon detection of the minimum area, the output from predictor computer 16 is gated, via selector switch 26 and gate 24 to the gun line offset servo 18. The performance of the servo is plotted in FIG. 5.

If, due to a particular strategic situation, it is desirable for the offset servo 18 to undergo constant motion, selector switch 26 is positioned in contact with voltage level lead 28 thereby permitting the servo 18 to receive constant data from predictor computer 16.

Thus far, the discussion of the block diagram has centered about the command and response of the gun line offset servo 18. In order to actually cause firing of a gun, gun fire control 20 must be energized. Typically, this is done by an electrical signal which activates the gun firing pin, in response to an operator's depression of a trigger. In the present invention, it is recognized that the closest approach miss distance between the projectile and the target will occur at $t_o+\Delta t_f$ as discussed in connection with FIG. 3. Thus, if the gun fire control 20 could be provided with a firing command at instant $t_o$ the closest approach miss distance between the projectile and target would be enhanced. This is ensured when estimator 14 detects the target line-of-sight angular velocity zero crossing or target minimum area, either of which will occur in the vicinity of $t_o$ according to empirical observations. After detection of this condition, a firing command is provided along lead 30 to gate 32. When there is coincidence between the firing command signal and trigger actuation by the gun operator, the gun fire control 20 is actuated and the weapon is fired.

We wish it to be understood that we do not desire to be limited to the exact details of construction shown and described for obvious modifications can be made by a person skilled in the art.

We claim:

1. A weapon fire control system comprising:

optical tracking means for generating target tracking data signal;

estimating means connected to the output of the tracking means for filtering the tracking data signals and detecting target area exceeding a minimum threshold;

predicting means having its input connected to the output of the estimating means for computing the offset equation relating target present and future position $$T_f = T_p + \left[1 - \frac{\omega^2 \Delta t_f^2}{12}\right] \cdot \frac{1}{2} A_N \Delta t_f^2$$

where $T_f$, $T_p$=target position-future and present $A_N$=target acceleration normal to target velocity V=target velocity $\Delta t_f$=projectile time-of-flight $A_{N/V}=\omega$ $\omega$=cyclic frequency of maneuvering target;

gating means connected at its inputs to the outputs of the estimating means and the predicting means, the gating means being enabled by the area threshold detection; and means responsive to the enabled gating means for offsetting a weapon from a line-of-sight of the optical tracking means, as a function of the computed offset, in preparation of firing a weapon.

2. The subject matter of claim 1 together with switching means for disconnecting the gating means from the estimating means and instead continuously enabling the gating means thus causing continuous weapon offsetting.

3. A weapon fire control system comprising:

optical tracking means for generating target tracking data signals;

estimating means connected to the output of the tracking means for filtering the tracking data signals and detecting zero crossing of target line-of-sight angular velocity as well as detecting target area exceeding a minimum threshold;

predicting means having its input connected to the output of the estimating means for computing the offset equation relating target present and future position:

$$T_f = T_p + \left[1 - \frac{\omega^2 \Delta t_f^2}{12}\right] \cdot \frac{1}{2} A_N \Delta t_f^2$$

where $T_f$, $T_p$=target position-future and present $A_N$=target acceleration normal to target velocity V=target velocity $\Delta t_f$=projectile time-of-flight $A_{N/V}=\omega$ $\omega$=cyclic frequency of maneuvering target;

means connecting the output of the predicting means to means for offsetting a weapon from a line-of-sight of the optical tracking means, as a function of the computed offset, in preparation of firing a weapon; and weapon firing means having an input connected to the output of the estimating means for firing the weapon in response to detection, by the estimating means, of a zero crossing of target line-of-sight angular velocity.

4. The subject matter set forth in claim 3 wherein connecting means comprises gating means connected at its inputs to the outputs of the estimating means and the predicting means, the gating means being enabled by an output of the estimating means when the latter detects a minimum target area threshold.

5. The subject matter set forth in claim 4 wherein the weapon is provided with a manual trigger and further wherein second gating means are provided with a first input set by actuation of the trigger and a second input set by the output of the estimating means when the minimum target area threshold is detected.

6. A weapon fire control system comprising:

optical tracking means for generating target tracking data signals;

estimating means connected to the output of the tracking means for filtering the tracking data signals and detecting target area exceeding a minimum threshold;

predicting means having its input connected to the output of the estimating means for computing the offset equation relating target present and future positions $$T_f = T_p + \left[1 - \frac{\omega^2 \Delta t_f^2}{12}\right] \cdot \frac{1}{2} A_N \Delta t_f^2$$

where $T_f$, $T_p$=target position-future and present $A_N$=target acceleration normal to target velocity V=target velocity $\Delta t_f$=projectile time-of-flight $A_{N/V}=\omega$ $\omega$=cyclic frequency of maneuvering target;

means connecting the output of the predicting means to means for offsetting a weapon from a line-of-sight of the optical tracking means, as a function of the computed offset, in preparation of firing a weapon; and weapon firing means having an input connected to the output of the estimating means for firing the weapon in response to the detection, by the estimating means, of the minimum target area threshold.

7. The subject matter set forth in claim 6 wherein the connecting means comprises gating means connected at its inputs to the output of the estimating means and the predicting means, the gating means being enabled by the area threshold detection.

* * * * *